US009060237B2

(12) United States Patent
Kirsch et al.

(10) Patent No.: US 9,060,237 B2
(45) Date of Patent: Jun. 16, 2015

(54) MUSICAL MEASUREMENT STIMULI

(75) Inventors: James Kirsch, Salt Lake City, UT (US); Harsha Inna Kedage Rao, Salt Lake City, UT (US)

(73) Assignee: Harman International Industries, Incorporated, Northridge, CA (US)

( * ) Notice: Subject to any disclaimer, the term of this patent is extended or adjusted under 35 U.S.C. 154(b) by 453 days.

(21) Appl. No.: 13/172,612

(22) Filed: Jun. 29, 2011

(65) Prior Publication Data

US 2013/0000464 A1 Jan. 3, 2013

(51) Int. Cl.
*H04S 7/00* (2006.01)
*H04R 25/00* (2006.01)

(52) U.S. Cl.
CPC ..... *H04S 7/301* (2013.01); *H04R 25/453* (2013.01); *H04S 7/305* (2013.01); *H04S 7/307* (2013.01)
USPC ..... 84/723; 84/600; 84/603; 84/616; 84/622; 84/654; 84/659; 84/735

(58) Field of Classification Search
None
See application file for complete search history.

(56) References Cited

U.S. PATENT DOCUMENTS

| | | | | |
|---|---|---|---|---|
| 4,306,113 | A | 12/1981 | Morton | |
| 6,137,904 | A * | 10/2000 | Lubin et al. | 382/162 |
| 6,360,022 | B1 * | 3/2002 | Lubin et al. | 382/260 |
| 6,654,504 | B2 * | 11/2003 | Lubin et al. | 382/254 |
| 7,842,874 | B2 * | 11/2010 | Jehan | 84/609 |
| 2002/0018573 | A1 * | 2/2002 | Schwartz | 381/98 |
| 2012/0057720 | A1 * | 3/2012 | Van Leest | 381/71.11 |
| 2012/0140965 | A9 * | 6/2012 | Jensen et al. | 381/318 |
| 2012/0148060 | A1 * | 6/2012 | Isberg | 381/71.1 |

(Continued)

FOREIGN PATENT DOCUMENTS

| | | | |
|---|---|---|---|
| DE | 102005028742 | B3 | 9/2006 |
| EP | 0119645 | A1 | 9/1984 |

(Continued)

OTHER PUBLICATIONS

Hawksford, M.O.J,; System Measurement and Identification Using Pseudorandom Filtered Noise and Music Sequences; J. Audio Eng. Soc.; vol. 53; No. 4; Apr. 2005; pp. 275-296.

(Continued)

*Primary Examiner* — Marlon Fletcher
(74) *Attorney, Agent, or Firm* — Brooks Kushman P.C.

(57) ABSTRACT

Systems and method for performing adaptive audio signal processing using music as a measurement stimulus signal. A musical stimuli generator may be used to generate musical stimulus signals composed to provide a stimulus with a spectrum that is substantially dense, and ideally white or pink, over a selected frequency range, so that all frequencies of interest are stimulated. The musical stimuli generator may generate melodically pleasing musical stimulus signals using music clips that include any of: a chromatic sequence, a chromatic sequence including chromatic tones over a plurality of octaves, a chromatic sequence including chromatic tones over a selected plurality of octaves, or an algorithmically composed chromatic sequence, to cover a selected frequency range. The musical stimulus signal may be generated as sound into the environment of use. An audio input picks up the sound from the environment, and a sound processor uses the received musical stimulus signal to determine a transfer function.

23 Claims, 7 Drawing Sheets

(56) References Cited

U.S. PATENT DOCUMENTS

| | | | | |
|---|---|---|---|---|
| 2012/0177221 | A1* | 7/2012 | Christoph | 381/94.1 |
| 2012/0268563 | A1* | 10/2012 | Chou et al. | 348/46 |
| 2013/0000464 | A1* | 1/2013 | Kirsch et al. | 84/609 |
| 2013/0144615 | A1* | 6/2013 | Rauhala et al. | 704/225 |
| 2013/0251167 | A1* | 9/2013 | Gautama | 381/66 |

FOREIGN PATENT DOCUMENTS

| | | | |
|---|---|---|---|
| EP | 1482763 | A2 | 12/2004 |
| EP | 2012558 | A2 | 1/2009 |
| WO | 0182650 | A2 | 11/2001 |

OTHER PUBLICATIONS

International Search Report and Written Opinion for corresponding Application No. PCT/US2012/042932, mailed Oct. 30, 2012, 14 pages.

International Preliminary Report for corresponding Application No. PCT/US2012/042932, mailed Jan. 16, 2014, 9 pages.

European Office Action for corresponding Application No. 12 741 403.5, mailed Oct. 13, 2014, 5 pages.

English translation for DE 10 2005 028 742 B3, Sep. 21, 2006, 5 pages.

* cited by examiner chromatic diminished chords ranging from 50Hz to 250Hz

MUSICAL MEASUREMENT STIMULI

BACKGROUND

1. Field of the Invention

The invention relates to audio systems, and more particularly, to audio systems using stimulus signals for measurement of transfer functions.

2. Related Art

Audio systems often include one or more applications in which transfer functions are adapted for changed conditions. Such applications typically determine the transfer function by measuring the response to a known stimulus signal, which may be a signal classified as 'noise' in the specific audio system. Such signals typically include white/pink noise and tone sweeps. There are multiple applications of this type of transfer function measurement.

One example application is Active Noise Cancellation in a typical audio system in which sound is to be played over one or more loudspeakers. Active noise cancellation involves adapting a cancellation filter using the transfer function of the path (also known as the secondary path) between the controlling loudspeakers and the sensing microphones. If this transfer function changes during use, the effectiveness of the noise cancellation is affected. The noise cancellation effectiveness may diminish; or worse, the system may introduce instability by adding noise instead of cancelling it. For example, the transfer function for audio in a car may be measured by the audio system manufacturer once per model of car, or by the car manufacturer once per car. During the use of the car, the transfer function may change under a variety of conditions. The transfer function may change when the occupancy changes, such as when passengers get in and out, or when cargo is added or removed. The transfer function may also change when temperature and humidity changes, or when a window is opened or closed.

Another application involving stimulus signals to measure a transfer function involves the estimation of a hearing aid feedback path. The filter that actively cancels feedback in a hearing aid operates using a model of the path from the hearing aid receiver (the little loudspeaker in the ear canal) to the external microphone. A transfer function of this model is typically measured once by the audiologist when the wearer is first given the hearing aids. Over the course of any day, a hearing aid moves around the ear canal, introducing various leaks. Over the course of weeks, wax can build up in an ear canal and change the acoustic path, especially when the receiver is plugged. Over the course of years, the ear canal can change shape and size, especially with younger wearers.

Another application involving stimulus signals to measure a transfer function involves the tuning of a concert sound system. Concert sound systems are typically tuned during sound checks prior to the concert when the venue is likely empty. As the venue fills with concertgoers with clothed bodies that absorb sound, the transfer function of the sound system changes significantly. The transfer function may change further as those people breathe air. This makes the venue warmer and more humid, which affects the speed of sound and therefore the transfer function of the sound system.

The tuning of a home theater system is another example application, which is similar to the tuning of a concert sound system. Tuning is typically done during installation of the system. The transfer function can change when the décor changes, such as the addition or removal of curtains, carpeting, and furniture, or if any of the loudspeakers need to be moved.

A similar application to both home theater tuning and active noise cancellation is the tuning of a car audio system. The transfer function between the loudspeakers and the listeners' ears can change when the occupancy, cargo, temperature, or humidity changes in the car cabin.

As noted above, applications that measure and/or adjust the transfer function in an audio system use a stimulus signal for which a response is measured. The stimulus signals typically include white or pink noise, or tone sweeps, which is unpleasant for the listener to hear. In active noise cancellation applications, the stimulus signal may cancel the purpose of the application. There is a need for a less unpleasant way of performing transfer function measurement.

SUMMARY

In view of the above, systems and methods are provided for measuring a response to an audio signal in an environment of use for an audio system. In an example method, a musical stimulus signal that has been composed to provide a substantially spectrally dense stimulus over a selected frequency range is generated so that all frequencies of interest are stimulated. A musical sound is generated from the musical stimulus signal in the environment of use. The musical sound is received at an audio input in the environment of use. The received musical sound is used to calculate a transfer function that characterizes the environment of use.

In an example system, a musical stimuli generator generates the musical stimulus signal for output to the environment of use. The musical stimuli generator may be configured to generate chromatic sequences. The chromatic sequences may include a plurality of octaves to cover a desired frequency range.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The description below may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1A:
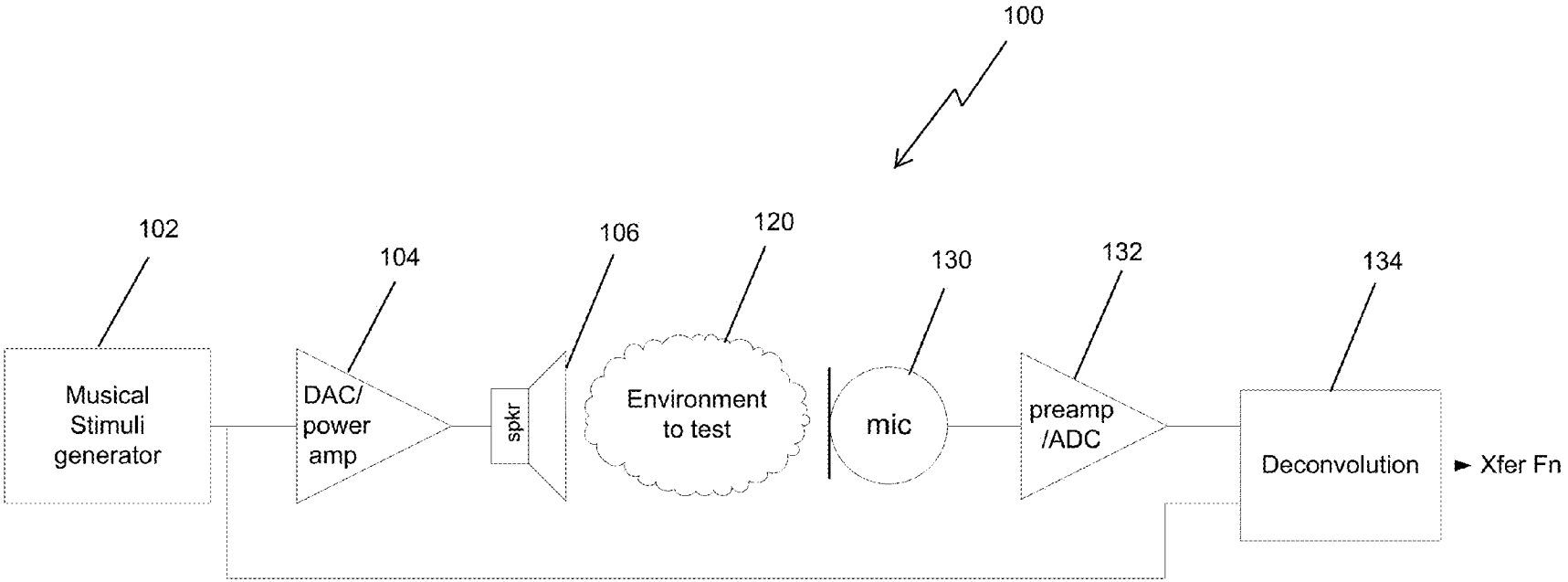
FIG. 1A is a block diagram of an example application using an example musical stimuli generator.

FIG. 1A is a block diagram of an example application 100 using an example musical stimuli generator 102. The application 100 in FIG. 1A includes a digital-to-analog converter/power amp ("DAC/AMP") 104, a loudspeaker 106, a microphone 130, a preamplifier/analog-to-digital converter ("preamp/ADC") 132, and a deconvolution function 134. The musical stimuli generator 102 generates a musical measurement signal. The musical measurement signal is received by the DAC/AMP 104. The DAC/AMP 104 converts the digital musical measurement signal to analog at a suitable power output level for the loudspeaker 106. The loudspeaker 106 generates an audio signal that corresponds to the received musical measurement signal into a test environment 120.

The audio signal is received at the microphone 130 as a test musical measurement signal. The test musical measurement signal transfers an electrical analog signal corresponding to the audio signal to the preamp/ADC 132. The preamp/ADC 132 conditions the signal by amplifying the signal to a suitable power level. The preamp/ADC 132 also converts the analog signal to digital samples. The deconvolution function 134 receives the digital representation of the test musical measurement signal. The deconvolution function 134 may also receive the original musical measurement signal directly from the musical stimuli generator 102. The deconvolution function 134 performs a deconvolution of the test musical measurement signal and the original musical measurement signal to generate the transfer function of the test environment 120. The deconvolution function 134 may be implemented using any suitable processor including a digital signal processor. The transfer function generated may then be used in accordance with an adaptive function in the application 100.

It is noted that the application 100 described with reference to FIG. 1A is a generalized example that may be modified for any suitable application in which the transfer function of an audio system is measured. In general, the DAC/AMP 104 and loudspeaker 106 may be components of the audio system under test with a connection to the musical stimuli generator 102 for purposes of using the application 100 in which the transfer function is to be measured. The application 100 may also be an active noise cancellation involving measurement of a secondary path, which is the path that sound follows between the noise cancelling loudspeaker 106 and the error microphone 130 where the noise is to be minimized. Advanced active noise cancellation algorithms periodically monitor the transfer function of the secondary path so as to prevent instability in the cancellation.

It is further noted that the example application 100 in FIG. 1A may be used in any type of audio system, which may include an home audio entertainment system, an audio system in an automobile, a public presentation audio system such as a concert sound system, hearing aids, or any other type of audio system in which the transfer function between audio output and listener may be measured. In addition, the application 100 itself may be for any suitable purpose that involves measuring a transfer function. The application 100 may be for active noise cancellation, audio system tuning, sound equalization, or any other suitable application.

The test environment 120 may be any environment in which the audio system is used. The microphone 130, preamp/ADC 132, and transfer function estimator 134 may be components of a separate test device, which may be configured in conjunction with the musical stimuli generator 102. The microphone 130, preamp/ADC 132, and transfer function estimator 134 may also be built-in as components of the audio system. The microphone 130, preamp/ADC 132, and transfer function estimator 134 may also be some of the components of a system or apparatus having additional components, features, and/or functions. The transfer function output by the transfer function estimator 134 may be communicated to functions and/or components in the audio system that may use the measured transfer function to adjust the audio system output (or the active noise cancellation function).

The musical stimuli generator 102 may be configured to generate a desired music clip to be used as a measurement stimulus signal. The musical stimuli generator 102 may generate music sequences of any desired length according to the measurement that is to be made. The measurement stimulus signal may be any musical signal that is substantially spectrally dense in a frequency range of interest so that all frequencies of interest are stimulated. Typically, spectrally flat broadband stimuli are used. For a measurement stimulus signal generated by the musical stimuli generator 102, the signal should have a spectrum that is as flat as possible, and sufficiently dense so that all frequencies of interest are stimulated. For example, if a note in the musical sequence were repeated, the spectra would have an extra bump or peak in it, which would be acceptable to the measurement process. However, a dip or a notch in the spectra would leave those frequencies effectively unmeasured.

An example musical stimuli generator 102 generates a measurement stimulus signal that has note pitches that cover enough octaves to reach an upper frequency of a frequency range for which the measurement is to be made. An example measurement stimulus signal may also have chromatic tones, which have all 12 note pitches in an octave instead of the 5 to 8 note pitches in an octave of tonal music). The measurement stimulus signal may also include glissandos or portamentos between notes, vibratos on the notes, or mis-tunings where part of the melody is out of tune by half of a semitone (50 cents, or a 24th of an octave) or even finer. The stimulus may consist of fundamental tones with overtones, such as those from a musical instrument. The overtones are typically harmonically related to the fundamental, but may also be unrelated as with many percussion instruments. An example of an instrument with many overtones but which are not harmonically related to the fundamental is a snare drum, which has a dense spectrum.

In an example musical stimuli generator 102, the measurement stimulus signal may be generated by selecting a segment of music from memory according to the application being performed. The music segments may be composed manually, then played and recorded for storage in memory to which the musical stimuli generator 102 has access. Music segments may also be composed algorithmically, or algorithmically and manually in combination. In combination, a computer may compose options from which a human may select based on aesthetics. The generated or selected music segments may then be played and recorded for storage in memory.

In an example musical stimuli generator 102, the measurement stimulus signal may include musical segments algorithmically composed by a computer and stored in memory for playback, or algorithmically composed music segments may be generated for playback as they are composed. Computers may be programmed in accordance with mathematical models that use stochastic processes to compose a piece of music by non-deterministic methods. The compositional process may be partially controlled by a human composer choosing the weights of possibilities of random events. The mathematical models may include, but are not limited to, Markov models and fractals. The algorithmic compositional process may also implement techniques from different branches of computer science such as artificial intelligence, cellular automata, chaos theory, neural networks, and transition networks. Grammars, knowledge-based systems, and learning systems may be used to determine patterns and rules of existing compositions and musical genres that may be used to generate music following those patterns and rules. Evolutionary methods involving genetic algorithms that iterate over mutations and natural selection may also be implemented in algorithmic composition. Selection and grouping of music clips may be made by another algorithm or by a human composer.

The musical stimuli generator 102 provides measurement stimuli in the form of music, which may be composed whether manually or algorithmically to be more pleasant to the listener than traditional stimuli. To sound more musical to a listener, a melody should contain phrases that flow around contours, similar to how sentences are spoken by a human. If there is too much consistency in the pitch or the pitch intervals, e.g. a long chromatic scale from the lowest pitch to the highest pitch, the sequence will sound boring. If there is too much randomness in the pitches, the sequence will not have any contour so it will sound erratic. Interval jumps between adjacent notes in a melody may be different from note to note, for example semitone, whole tone, minor third, major fourth, diminished fifth, octave, etc., although in most popular melodies smaller interval jumps occur more frequently than larger jumps. Interval directions between adjacent notes may have three possible signs: positive, whereby the following note increases in pitch, negative, whereby the following note decreases in pitch, and zero, whereby the note is repeated.

Melodic phrasing may also be enhanced by rhythm and accents. Pauses between groups of notes can sound like breaths between phrases in a person talking, and pauses or gaps in the time domain do not cause gaps in the frequency domain, so the spectra will still be dense as required. Rhythms that deviate from simple constant note durations can enhance the sense of melody, so adjacent notes also need not be the same duration or even volume, however spectral flatness would require the sum of the duration of each pitch to be the same.

Examples of musical sequences that may be used in example implementations of a musical stimuli generator 102 are described below with reference to FIGS. 3A-3C.

Figure 1B:
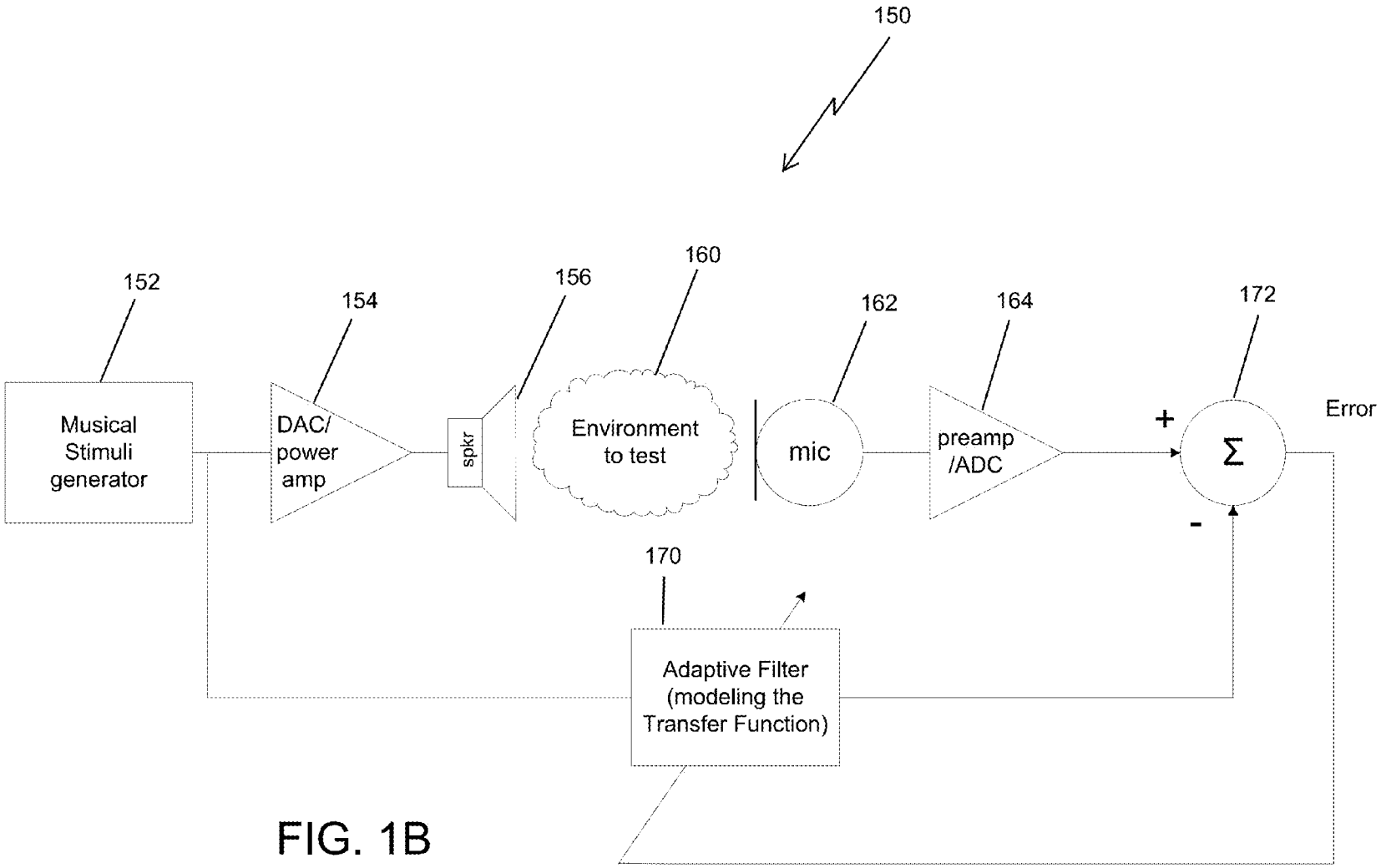
FIG. 1B is a block diagram of another example application using an example musical stimuli generator.

FIG. 1B is a block diagram of another example application 150 using an example musical stimuli generator. The application 150 in FIG. 1B includes a musical stimuli generator 152, a DAC/power amplifier 154, and a loudspeaker 156 configured to generate musical stimulus sound signals in an environment to test 160. The musical stimulus signals are picked up by an audio signal pickup (microphone) 162 and conditioned by a pre-amplifier/ADC 164, which outputs a digital input signal. The musical stimulus signal generated by the musical stimulus generator 152 is also received by an adaptive filter 170. The adaptive filter in FIG. 1B may be programmed to model the transfer function of the test environment 160 for use in a desired application such as equalization, active noise cancellation, or any other application that operates using the transfer function. The output of the adaptive filter 170 represents the musical stimulus signal conditioned in accordance with the frequency response used to program the adaptive filter 170. The digital input signal received via the microphone 162 is provided to an adder 172, which determines a difference between the digital input signal and the conditioned signal output of the adaptive filter 170. The difference is an error signal that may be fed back to the adaptive filter 170, which uses the error signal to update the frequency response of the adaptive filter 170 based on changes in the transfer function of the test environment 160. Eventually, the adaptive filter 170 has knowledge of the transfer function of the environment.

Figure 2:
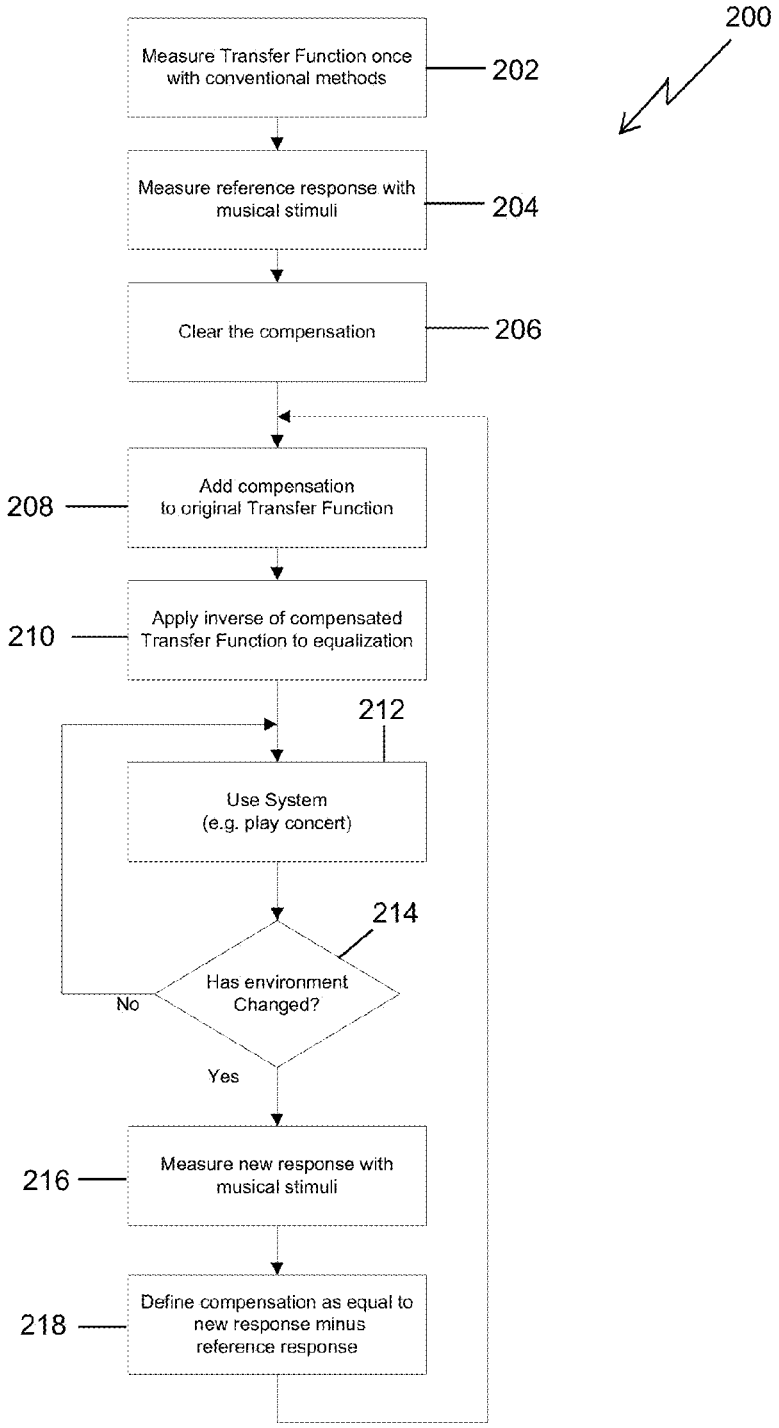
FIG. 2 is a flowchart illustrating operation of an example method for adapting a transfer function.

FIG. 2 is a flowchart 200 illustrating operation of an example method for adapting a transfer function. The method illustrated in FIG. 2 may be performed in an example audio system that incorporates an example of the application 100 in FIG. 1A. The example method illustrated in FIG. 2 is described in the context of an equalization function in an audio system. However, other adaptive functions may employ an example method similar to the example illustrated in FIG. 2 for updating a transfer function.

The audio system includes an audio signal generator (not shown) that is to be output via the loudspeaker 106 in FIG. 1A. A transfer function for the environment to test 120 in FIG. 1A is measured and subsequently adapted as the audio system is used while conditions in the environment to test 120 change.

Referring to step 202 in the flowchart 200 shown in FIG. 2, a transfer function may be measured using conventional methods. For example, the transfer function measurement in step 202 may involve an initial transfer function measurement for a car audio system during installation in a car. Step 202 may also be performed in calibrating a hearing aid for use, or in initializing an active noise cancellation application for operation. Step 202 may be optional in some applications since the method in FIG. 2 operates adaptively. However, step 202 may be performed in a manner that results in a highly accurate transfer function. For example, step 202 may be performed over a long duration (sometimes minutes), with a signal likely having a denser spectrum (e.g. pure noise or a pure sweep).

At step 204, a reference response is obtained using a musical measurement signal generated by, for example, the musical stimuli generator 102 in FIG. 1A. The reference response is a frequency response of the environment of use based on a transfer function measured using musical measurement stimuli. In an iterative process, a compensation is determined according to the difference between the reference response or a frequency response based on a prior transfer function, and the frequency response based on the transfer function measured after the environment of use changes. The reference response calculated in step 204 is determined before the environment has a chance to change. At step 206, the compensation is cleared, or set to zero.

Step 208 is part of the iterative process in which the transfer function of the environment of use is determined as the environment of use changes. As the transfer function changes, a compensation that represents the change in the transfer function is determined. During use of the audio system that shortly follows the measurement of the original transfer function and before the environment changes enough to affect the transfer function, the compensation is zero, or substantially zero. At step 208, the compensation is added to the original transfer function to determine the compensated transfer function to be used for equalization. At step 210, the inverse of the compensated transfer function is applied to the equalization function to be used during performance or output of the audio signal.

Steps 202-210 may be performed during a sound check for a concert audio system, or for calibration of the audio system for use, whether generally or in a specific environment. At step 212, the audio system is used in the targeted environment, such as for example, a concert performance, or by a driver of a car having the calibrated audio system, or by the user of a hearing aid. During use of the audio system, the environment may change in a manner that affects the transfer function used in equalizing the sound, which may result in a change in the user's experience of the sound generated by the audio system. Decision block 214 tests for such an environment change. The test employed in decision block 214 may include any suitable test according to the specific audio system, and according to the resources available to detect the change. Decision block 214 may also include a periodic test or employ a time period with the assumption that the environment has changed over the specified time period. If decision block 214 detects no change to the environment, the use of the audio system continues at step 212.

If decision block 214 detects a change to the environment, a new response based on a musical stimulus is obtained at step 216 using, for example, the musical stimuli generator 102 in FIG. 1A. At step 218, a compensation is calculated by subtracting the original reference response from the new response measured in step 216. The compensation is then added to the original transfer function at step 208, which is used to modify the equalization function in the audio system for use of the audio system.

The example method illustrated in the flowchart in FIG. 2 may operate continuously or repeatedly to adaptively update the transfer function used for equalization in an audio system. It is noted that while FIG. 2 illustrates updating a transfer function in an equalization application, other types of adaptive functions may involve transfer functions that may change as the environment of use changes.

Figure 3A:
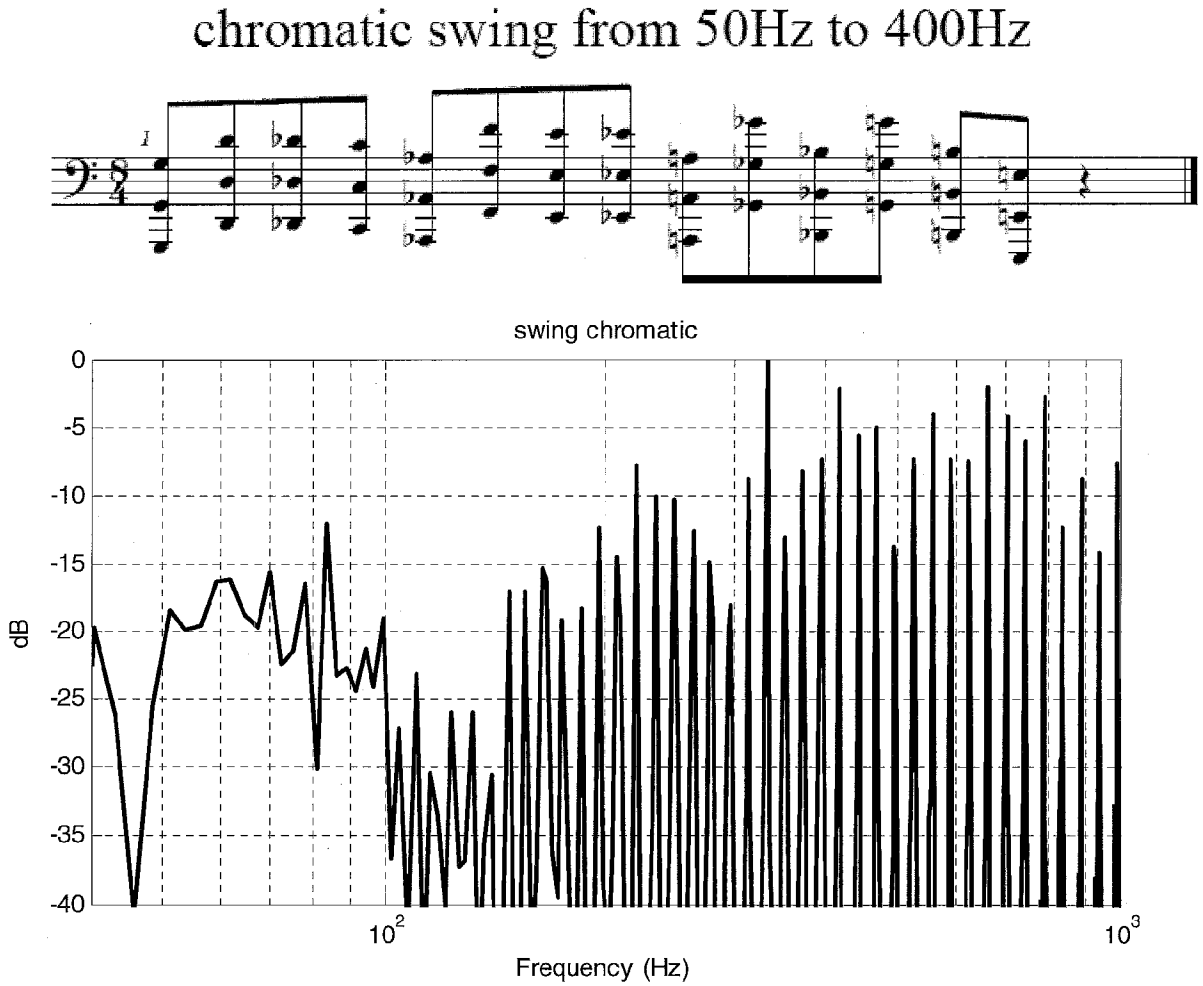
FIG. 3A-3C are example chromatic sequences that may be used in generating a musical measurement stimulus signal.
Figure 3B:
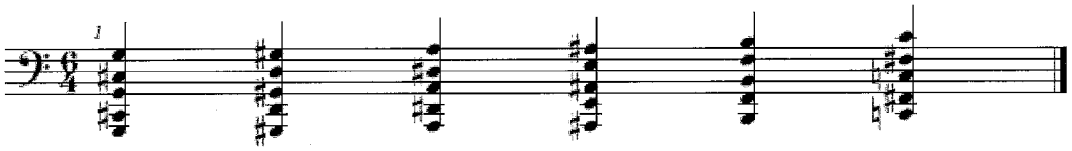
Figure 3B:
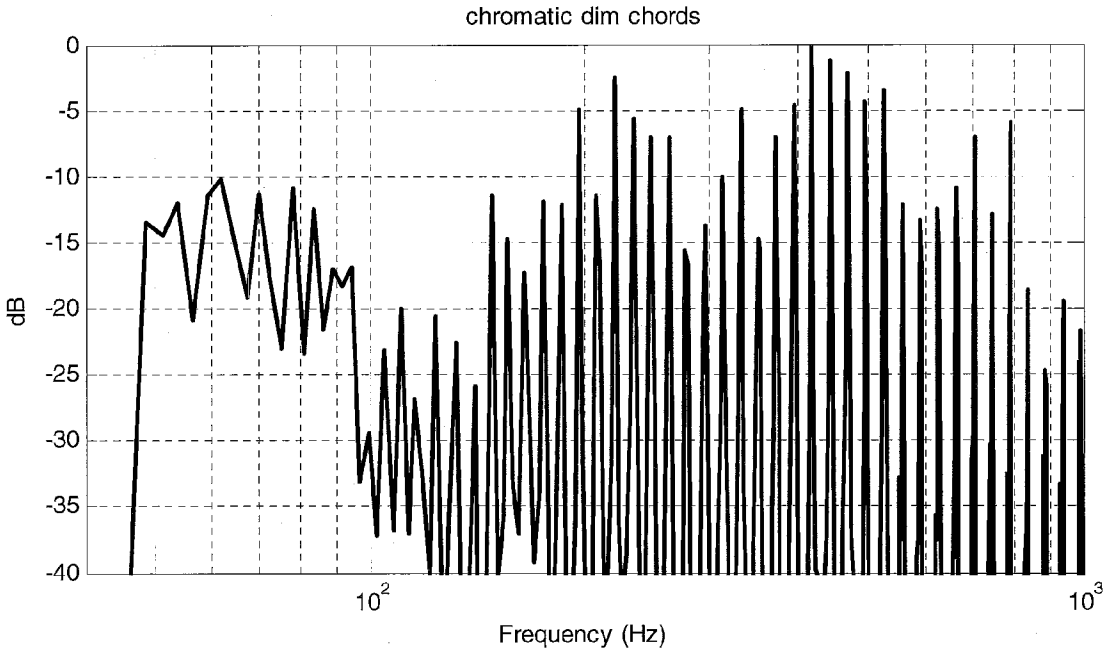
Figure 3C:
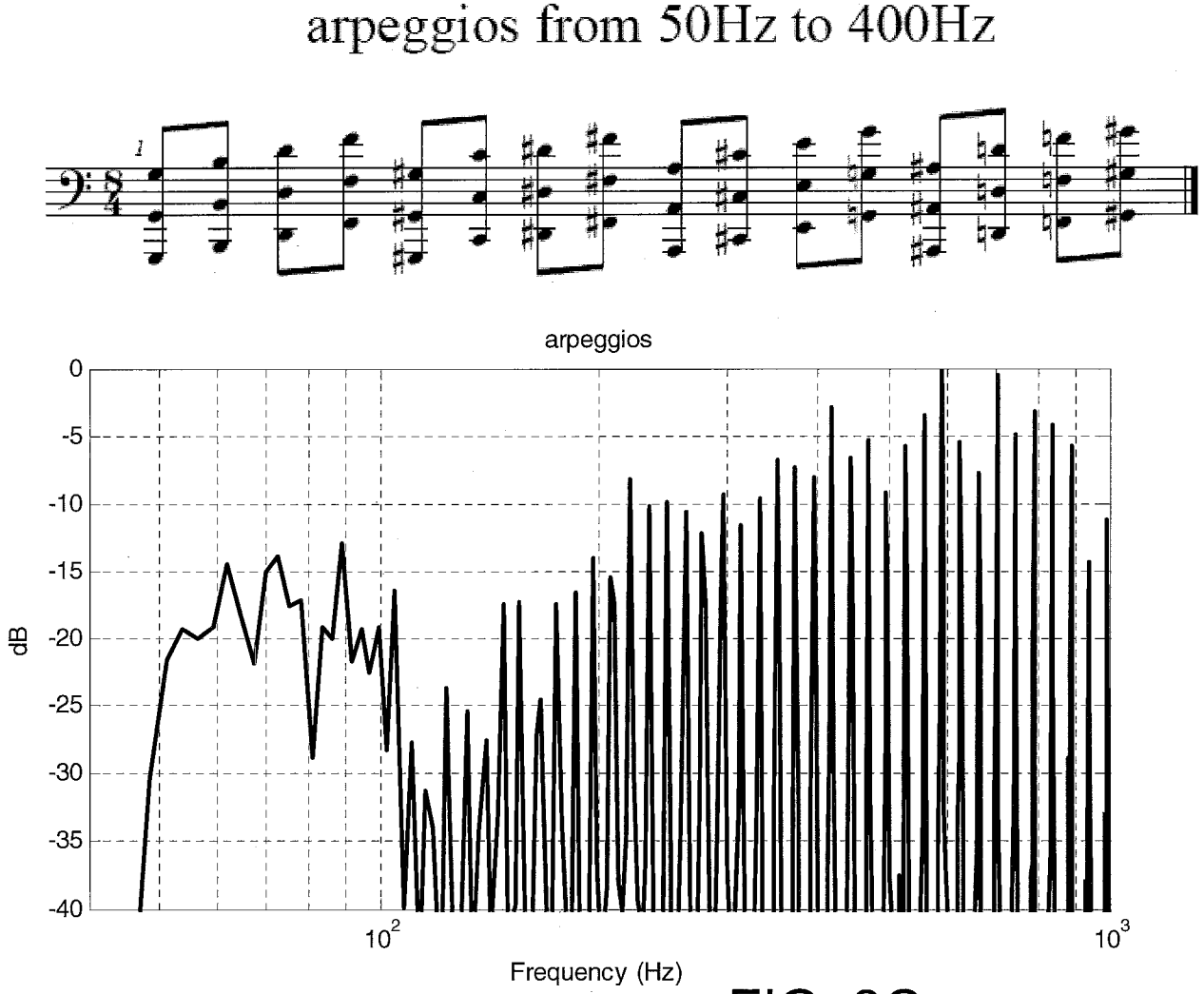

FIG. 3A-3C are example music sequences that may be used in generating a musical measurement stimulus signal. The three music sequences were composed chromatically so as to be spectrally dense, and were generated with a synthesized bass guitar sound. FIG. 3A shows the score and spectrum of a chromatic swinging walking bass line with tones whose fundamentals range from 50 Hz to 400 Hz. FIG. 3B shows the score and spectrum of a set of chromatic diminished chords with tones whose fundamentals range from 50 Hz to 250 Hz. FIG. 3C shows the score and spectrum of arpeggios with tones whose fundamentals range from 50 Hz to 400 Hz. The sequences in FIGS. 3A, 3B, 3C have a duration of 5.6, 3.3, and 5.6 seconds respectively. The synthesized bass guitar sound has harmonic overtones that have spectral peaks above the highest fundamental of 400 Hz, that moreover cause the spectra to deviate from flat but are still dense. A sinusoid generator following these musical sequences would create flatter spectra than the synthesized bass.

Figure 4:
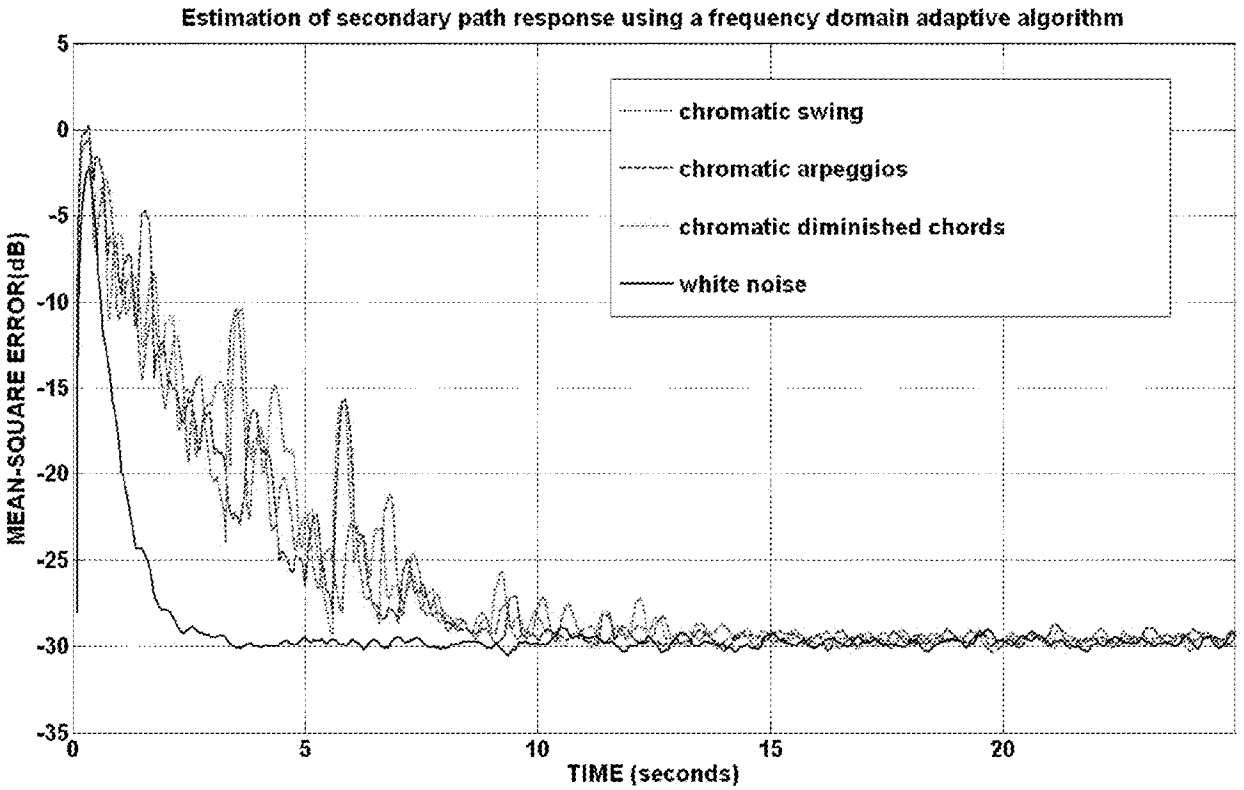
FIG. 4 is a graph illustrating convergence behavior of an adaptive algorithm using white noise and example musical stimuli.

It is noted that the frequency ranges specified in FIGS. 3A to 3C are provided as examples of frequency ranges that may be used for these musical sequences. Other musical sequences may be generated for different frequency ranges. The musical sequences illustrated in FIGS. 3A-3C may also be extended to higher frequencies by either stacking octaves on the existing sequences, or appending repeats of the sequences at different octaves. FIG. 4 is a graph illustrating convergence behavior of the adaptive algorithm using white noise and the example musical stimuli illustrated in FIGS. 3A-3C. The results shown in FIG. 4 were generated using an example implementation in which the three music sequences shown in FIGS. 3A, 3B, and 3C were used to estimate the transfer functions. The estimated transfer functions were further applied to the modified filtered-X least mean square (LMS) simulations used by HALOsonic™, which is an example active noise cancellation application. The musical stimuli illustrated in FIGS. 3A-3C were replicated to estimate convergence time. A frequency domain adaptive algorithm was used to perform an initial offline estimation of the secondary path frequency response. The graph in FIG. 4 shows the convergence behavior for the three music sequences in FIGS. 3A, 3B, and 3C as well as for the use of white noise. The graph in FIG. 4 shows that despite being slower than white noise stimulus, convergence was still achieved using the stimuli in FIGS. 3A-3C, taking only 8 seconds for convergence to a 30 dB noise floor. It is noted that convergence is faster for more spectrally flat stimulus signals so that example music sequences that are more spectrally flat should converge faster.

It is also noted that the example implementation in FIG. 4 was for test purposes and illustrates only one application in which musical sequences may be used for measurement stimuli. Use of musical sequences is not limited to active noise cancellation applications as described above. In addition, the musical sequences may be applied to any other suitable active noise cancellation application that uses algorithms other than the modified filtered-X LMS algorithm, such as, without limitation, the filtered-X LMS and filtered error LMS. The HALOsonic application is also but one example of an active noise cancellation application in which the musical stimuli may be used.

It will be understood, and is appreciated by persons skilled in the art, that one or more processes, sub-processes, or process steps described in connection with FIGS. 1-4 may be performed by hardware and/or software. If the process is performed by software, the software may reside in software memory (not shown) in a suitable electronic processing component or system such as, one or more of the functional components or modules schematically depicted in FIG. 1A. The software in software memory may include an ordered listing of executable instructions for implementing logical functions (that is, "logic" that may be implemented either in digital form such as digital circuitry or source code or in analog form such as analog circuitry or an analog source such an analog electrical, sound or video signal), and may selectively be embodied in any computer-readable medium for use by or in connection with an instruction execution system, apparatus, or device, such as a computer-based system, processor-containing system, or other system that may selectively fetch the instructions from the instruction execution system, apparatus, or device and execute the instructions. In the context of this disclosure, a "computer-readable medium" is any means that may contain, store or communicate the program for use by or in connection with the instruction execution system, apparatus, or device. The computer readable medium may selectively be, for example, but is not limited to, an electronic, magnetic, optical, electromagnetic, infrared, or semiconductor system, apparatus or device. More specific examples, but nonetheless a non-exhaustive list, of computer-readable media would include the following: a portable computer diskette (magnetic), a RAM (electronic), a read-only memory "ROM" (electronic), an erasable programmable read-only memory (EPROM or Flash memory) (electronic) and a portable compact disc read-only memory "CDROM" (optical). Note that the computer-readable medium may even be paper or another suitable medium upon which the program is printed, as the program can be electronically captured, via for instance optical scanning of the paper or other medium, then compiled, interpreted or otherwise processed in a suitable manner if necessary, and then stored in a computer memory.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A method for measuring a response to an audio signal in an environment of use for an audio system comprising:

generating a musical stimulus signal composed to provide a spectrally dense stimulus over a selected frequency range;

generating a musical sound from the musical stimulus signal in the environment of use;

receiving the musical sound at an audio input in the environment of use; and using the received musical sound to calculate a transfer function that characterizes the environment of use, where the step of generating the musical stimulus signal includes: retrieving at least one selected chromatic sequence from memory, and where the step of generating the musical stimulus signal further includes:

algorithmically composing the at least one chromatic sequence; and generating a digital representation of the at least one chromatic sequence that is algorithmically composed.

2. The method of claim 1 where the step of generating the musical stimulus signal includes:

retrieving at least one selected music sequence from the memory.

3. The method of claim 1 where the step of generating the musical stimulus signal further includes:

retrieving the at least one selected chromatic sequence from the memory, at least one of the selected chromatic sequence using chromatic tones over a plurality of octaves.

4. The method of claim 1 where the step of generating the musical stimulus signal further includes:

retrieving the at least one selected chromatic sequence from the memory, at least one of the selected chromatic sequence using chromatic tones over a selected plurality of octaves to cover the selected frequency range.

5. The method of claim 1 where the step of generating the musical stimulus signal further includes:

retrieving at least one selected algorithmically composed chromatic sequence from the memory.

6. The method of claim 1 where the step of generating the musical stimulus signal further includes:

retrieving at least one selected algorithmically composed chromatic sequence from the memory, at least one of the selected chromatic sequence using chromatic tones over a plurality of octaves.

7. The method of claim 1 where the step of generating the musical stimulus signal further includes:

retrieving at least one selected algorithmically composed chromatic sequence from the memory, at least one of the selected chromatic sequence using chromatic tones over a selected plurality of octaves to cover the selected frequency range.

8. The method of claim 1 where the step of algorithmically composing the at least one chromatic sequence further includes:

algorithmically composing the at least one chromatic sequence using chromatic tones over a plurality of octaves.

9. The method of claim 1 where the step of algorithmically composing the at least one chromatic sequence further includes:

algorithmically composing the at least one chromatic sequence using chromatic tones over a selected plurality of octaves to cover the selected frequency range.

10. The method of claim 1 where the step of using the received musical sound to calculate a transfer function includes:

converting the received musical sound to a digital received musical sound; and comparing the digital received musical sound with the musical stimulus signal.

11. A method for adapting an audio system in a changing environment of use comprising:

determining an original transfer function for the audio system;

generating a musical stimulus signal composed to provide a stimulus with a substantially dense spectrum over a selected frequency range;

generating a musical sound from the musical stimulus signal in the environment of use;

measuring a reference response of the environment of use using the musical stimulus signal;

applying the reference response to an adaptive function in the environment of use;

repeating the steps of generating the musical sound, measuring the reference response, and applying the reference response to adapt the audio system to the changes in the environment of use, where the step of generating a musical stimulus signal includes: retrieving at least one selected chromatic sequence from memory, and where the step of generating the musical stimulus signal further includes:

algorithmically composing the at least one chromatic sequence; and generating a digital representation of the at least one chromatic sequence that is algorithmically composed.

12. The method of claim 11 where the step of generating the musical stimulus signal further includes:

retrieving at least one selected music sequence from the memory.

13. The method of claim 11 where the step of generating the musical stimulus signal further includes:

retrieving at least one selected chromatic sequence from the memory, at least one of the selected chromatic sequence using chromatic tones over a plurality of octaves.

14. The method of claim 11 where the step of generating the musical stimulus signal further includes:

retrieving at least one selected chromatic sequence from the memory, at least one of the selected chromatic sequence using chromatic tones over a selected plurality of octaves to cover the selected frequency range.

15. The method of claim 11 where the step of generating the musical stimulus signal includes:

retrieving at least one selected algorithmically composed chromatic sequence from the memory.

16. The method of claim 11 where the step of generating the musical stimulus signal further includes:

retrieving at least one selected algorithmically composed chromatic sequence from the memory, at least one of the selected chromatic sequence using chromatic tones over a plurality of octaves.

17. The method of claim 11 where the step of generating the musical stimulus signal further includes:

retrieving at least one selected algorithmically composed chromatic sequence from the memory, at least one of the selected chromatic sequence using chromatic tones over a selected plurality of octaves to cover the selected frequency range.

18. The method of claim 11 where the step of algorithmically composing the at least one chromatic sequence further includes:

algorithmically composing the at least one chromatic sequence using chromatic tones over a plurality of octaves.

19. The method of claim 11 where the step of algorithmically composing the at least one chromatic sequence further includes:

algorithmically composing the at least one chromatic sequence using chromatic tones over a selected plurality of octaves to cover the selected frequency range.

20. An adaptive application for use in an audio system, the adaptive application comprising:

a musical stimuli generator configured to generate a musical stimulus signal, the musical stimuli generator connected to output the musical stimulus signal to an audio output as a musical stimulus sound in an environment of use;

an audio input configured to receive a received musical stimulus sound; and a sound processor configured to determine a transfer function of the environment of use based on the received musical stimulus sound; where the musical stimuli generator includes:

an algorithmic composer configured to generate music sequences including any of the following types of music clips:

at least one selected chromatic sequence, at least one selected chromatic sequence where at least one of the selected chromatic sequence includes chromatic tones over a plurality of octaves, at least one selected chromatic sequence where at least one of the selected chromatic sequence includes chromatic tones over a selected plurality of octaves to cover a selected frequency range, and at least one selected algorithmically composed chromatic sequence.

21. The adaptive application of claim 20 where:

the musical stimuli generator further includes a memory for storing music sequences for use as the musical stimulus signal.

22. The adaptive application of claim 20 where:

the musical stimuli generator includes a memory for storing the music sequences for use as the musical stimulus signal where the music sequences include any of the following types of music clips:

the at least one selected chromatic sequence, the at least one selected chromatic sequence where the at least one of the selected chromatic sequence includes the chromatic tones over the plurality of octaves, the at least one selected chromatic sequence where the at least one of the selected chromatic sequence includes the chromatic tones over the selected plurality of octaves to cover the selected frequency range, and the at least one selected algorithmically composed chromatic sequence.

23. The adaptive application of claim 20 where the audio output is connected to an audio signal generating system to form an audio system selected from a group consisting of:

a home entertainment system, a public address system, a concert sound system, a hearing aid, and a vehicle audio system.

* * * * *